United States Patent [19]

Outlaw

[11] Patent Number: 4,930,773

[45] Date of Patent: Jun. 5, 1990

[54] CURVE BALL TRAINING DEVICE

[76] Inventor: James F. Outlaw, Rte. 1, Box 32C, Montalba, Tex. 75853

[21] Appl. No.: 177,611

[22] Filed: Apr. 5, 1988

[51] Int. Cl.[5] ..... A63B 69/00

[52] U.S. Cl. ..... 273/26 R; 273/323; 273/25; 434/247; 124/5

[58] Field of Search ..... 273/26 R, 26 C, 26 P, 273/323; 434/247; 124/5

[56] References Cited

U.S. PATENT DOCUMENTS

| | | | |
|---|---|---|---|
| 1,570,632 | 1/1926 | Kideney | 273/323 |
| 2,925,273 | 2/1960 | Pratt | 273/26 |
| 3,115,129 | 12/1963 | Merriman | 124/5 |
| 3,152,803 | 10/1964 | Sain | 273/26 |

FOREIGN PATENT DOCUMENTS

| | | | |
|---|---|---|---|
| 467364 | 6/1937 | United Kingdom | 273/323 |

*Primary Examiner*—Edward M. Coven
*Assistant Examiner*—Jessica J. Harrison
*Attorney, Agent, or Firm*—Richard J. Smith

[57] ABSTRACT

A device for training a baseball pitcher to throw a curve ball. The device comprises a chamber in the shape of a truncated cone having a spherical grip member, such as a baseball, connected thereto. The chamber has a cavity therein within which to snugly receive a ball to be thrown. A method for practicing the motor skills associated with throwing a curve ball is also disclosed.

10 Claims, 1 Drawing Sheet

CURVE BALL TRAINING DEVICE

BACKGROUND OF THE INVENTION

The present invention relates generally to a training device for a baseball pitcher. More particularly, the present invention relates to a device which may be utilized to train a baseball pitcher to throw a curve ball.

The act of pitching or throwing a curve ball requires the use of proper arm angle and wrist action during the pitching act in order to achieve the desired "curve" during the flight of the ball. In one prior training method for learning to throw a curve ball a stick is thrown in such a manner so as to cause the stick to flip end over end during its flight. In another prior method for learning to throw a curve ball, a tall can, such as a tennis ball can, is held between the palm of the pitching hand and the biceps of the pitching arm to thereby simulate the relative positioning of the palm, biceps, and forearm. However, a ball is not thrown in either of these prior methods. Further, neither of these prior methods permit the practicing pitcher to grip a ball with his or her pitching hand during the practice act.

SUMMARY OF THE INvENTION

Accordingly, the present invention provides an apparatus or device which may be utilized to practice the arm angle and wrist action associated with throwing a curve ball. Further, the present invention allows a practicing pitcher to actually grip a ball with his or her pitching hand while using the device. The present invention also provides a method for practicing the arm angle and wrist action associated with throwing a curve ball.

The preferred embodiment of the curve ball training device of the present invention comprises a chamber having a baseball grip member connected to the rearward end thereof. The chamber is in the shape of a truncated cone and has a mouth on the forward end thereof. The chamber has a cavity therein within which to snugly receive a ball to be thrown. The center of the grip member is preferably aligned with the central axis of the chamber.

During usage of the present invention, a ball to be thrown is inserted into the chamber and the practicing pitcher grips the baseball secured to the chamber. The practicing pitcher grips the baseball in such a manner that when the pitcher's arm is extended forward in a substantially horizontal position, the pitcher's hand is gripping the side of the baseball and the chamber extends upward therefrom. The practicing pitcher thereafter extends his pitching arm rearward and initiates a three-quarter to overhand delivery motion. When the pitching hand is brought forward and downward through the arc of the pitching delivery motion, the pitcher flips his or her pitching wrist downward at an appropriate point in the delivery arm path, thereby forcefully discharging the ball from the chamber and imparting a trajectory or vertical component and a direction or horizontal component to the flight path of the ball. When the pitching arm angle, pitching arm path, and wrist action are properly executed, the ball will be "pitched" to a preselected target and the "feel" associated with throwing a curve ball will be transferred or conveyed to the practicing pitcher.

DETAILED DESCRIPTION OF THE PREFERRED EMBODIMENT

Figure 1:
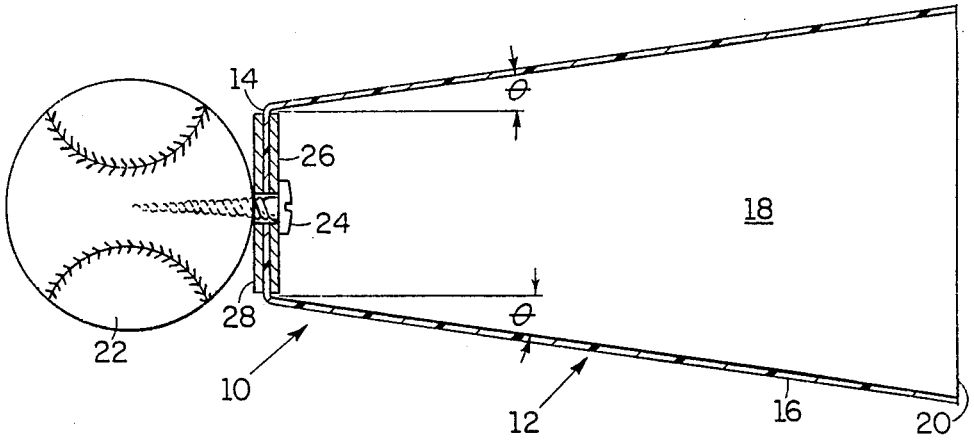
FIG. 1 is a cross sectional side view of the preferred embodiment of the curve ball training device of the present invention.
Figure 2:
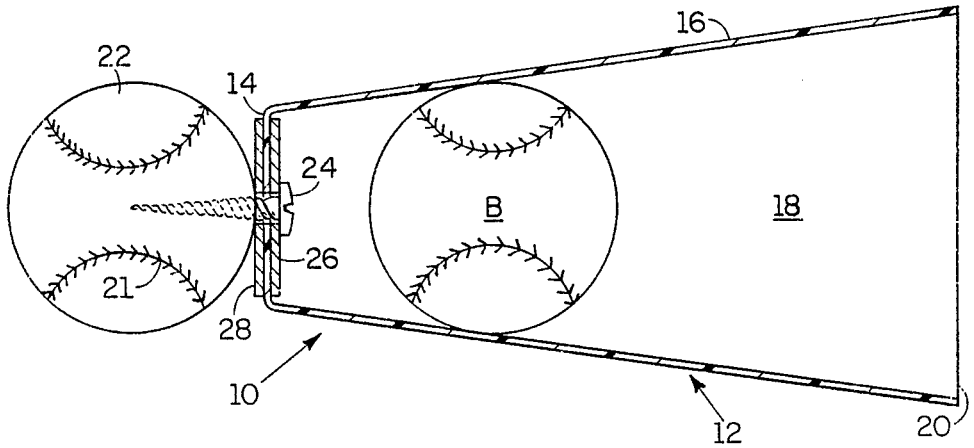
FIG. 2 is a cross sectional side view of the preferred embodiment of the curve ball training device of the present invention illustrating a ball within the chamber.
Figure 3:
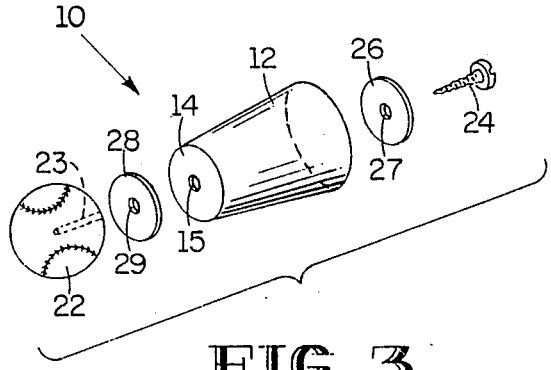
FIG. 3 is an exploded perspective view of the preferred embodiment of the curve ball training device of the present invention.

Referring to FIG. 1 and FIG. 3, the curve ball training device of the present invention is identified by the number 10. The device 10 comprises a housing or chamber 12 having a bottom or base 14 and a side wall 16. Bottom 14 has a hole 15 in approximately the center thereof. The bottom 14 and side wall 16 define a cavity 18 within chamber 12 adapted to receive a ball B therein, as illustrated in FIG. 2. Chamber 12 has a mouth or port 20 on the end thereof opposite bottom 14 which is adapted to permit insertion of the ball B into cavity 18 and discharge of the ball B from cavity 18.

Referring again to FIG. 1 and FIG. 3, the chamber 12 is preferably an integral piece of hard plastic which is molded as an integral piece and has a hole 15 in the bottom 14 thereof. Chamber 12 may be a substantially transparent plastic glass which has a hole 15 in the bottom 14 thereof. Further, chamber 12 is preferably in the shape of a truncated cone wherein side wall 16 has a substantially uniform taper from mouth 20 to bottom 14 and the inner diameter of side wall 16 gradually decreases from mouth 20 to bottom 14. Hole 15 is substantially aligned with the central axis of chamber 12. Side wall 16 preferably has an inner diameter of approximately three and five-eights inches ($3\frac{5}{8}''$) at the forward end thereof adjacent to mouth 20 and an inner diameter of approximately two and three-fourths inches ($2\frac{3}{4}''$) at the rearward end thereof adjacent to bottom 14. Side wall 16 preferably has a length of approximately six and three fourths inches ($6\frac{3}{4}''$) from bottom 14 to mouth 20. Further, chamber 12 preferably has a taper angle $\theta$ in the range of approximately ten (10) to twenty (20) degrees, and $\theta$ is preferably approximately fifteen (15) degrees.

Referring again to FIG. 1 and FIG. 3, the device 10 further comprises a substantially spherical grip member 22. In the preferred embodiment, grip member 22 is a baseball having a passage 23 therein which extends radially inward from the peripherY of the ball 22 to a depth of approximately one-half to three-fourths the diameter of the ball 22. Grip member or ball 22 is secured to chamber 12 exterior to cavity 18 by a lag screw 24 which extends through hole 15 into passage 23 within grip member 22. An inner support disk or plate 26, having a hole 27 in approximately the center thereof, is preferably positioned intermediate to the head of screw 24 and bottom 14. An outer support disk or plate 28, having a hole 29 in approximately the center thereof, is preferably positioned intermediate to grip member 22 and bottom 14. Disks 26 and 28 are preferably constructed of 16-gauge metal, are preferably circular with a diameter of approximately two and one half inches (2½"), and preferably have a thickness of approximately one fourth inch (¼"). Holes 27, 15, and 29 are adapted to receive screw 24 therethrough and passage 23 is adapted to receive screw 24 therein. Holes 27, 15, and 29 and passage 23 preferably have a diameter of approximately one fourth inch (¼").

Figure 4:
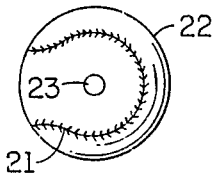
FIG. 4 is a side view of the baseball grip member of the curve ball training device of the present invention illustrating the preferred position of the passage within the baseball relative to the seams of the ball.

Referring to FIG. 3 and FIG. 4, the curve ball training device 10 is constructed by drilling passage 23 in ball 22 to a depth of approximately one-half to three-fourths of the diameter of the ball 22. Passage 23 is preferably located in a selected position relative to the seams 21 on the ball 22 to allow the practicing pitcher to grip the seams 21 in a desired manner. Passage 23 is preferably drilled in ball 22 in approximately the center of the widest separation point of the seams 21 on the ball 22, as illustrated in FIG. 4. Hole 15 is thereafter drilled in bottom 14 in the event chamber 12 does not already have a hole 15 in the bottom 14 thereof. Inner disk 26 is thereafter placed against the inside of bottom 14 with hole 27 aligned with hole 15, outer disk 28 is placed against the outside of bottom 14 with hole 29 aligned with hole 15, ball 22 is held against disk 28 with passage 23 aligned with hole 29 and lag screw 23 is inserted through holes 27, 15, and 29 and into passage 23. The ball 22 is held tightly against outer disk 28 by engaging the lag screw 24 to the proper depth in the ball 22. However, ball 22 may be rotated on screw 24 to a small degree. When the device 10 is properly constructed, holes 27, 15, and 29 and passage 23 are aligned, thereby aligning the center of ball 22 with the central axis of chamber 12.

The device 10 may be utilized to practice the motor skills associated with throwing a curve ball. The practicing pitcher selects a desired target, such as a catcher, to which a ball B, such as a conventional baseball, is to be "pitched" and inserts the ball B through port 20 into the cavity 18 so that the ball B is held snugly by side wall 16, as illustrated in FIG. 2. In this regard, it is to be understood that the taper and resiliency of side wall 16 allows the ball B to be inserted to a particular depth within cavity 18 wherein the ball B is held firmly within chamber 12 by the abutment of side wall 16 against ball B. This is due to the fact that the diameter of the ball B is greater than the inner diameter of the rearward end of side wall 16. For example, the diameter of a conventional baseball is approximately three inches (3"). The training pitcher thereafter grips the ball member 22 with his or her pitching hand in a manner such that when the pitcher's arm is extended forward in a substantially horizontal position, the pitcher's hand is gripping the side of member 22 and chamber 12 extends upward therefrom. The pitcher's index finger and forefinger are preferably together and the pitcher's palm faces to the left (for a right handed pitcher) or right (for a left handed pitcher). When the baseball 22 is gripped properly, the pitching arm (the arm having the pitching hand attached thereto) will be at an appropriate angle. The pitcher thereafter extends his pitching arm and pitching hand rearward away from the desired target and thereafter initiates a three quarter to overhand delivery motion. As the pitcher's pitching hand is brought forward and downward through the arc of the pitching delivery motion toward the desired target, the pitcher flips his or her pitching wrist downward ar an appropriate point in the arm path of the delivery, thereby forcefully discharging the ball B from the chamber 12 through port 20 and imparting a trajectory or vertical component and a direction or horizontal component to the flight path of the ball B. That is, the ball B is forcefully discharged from chamber 12 and "pitched" forward in a desired direction and with a slightly arched trajectory when the chamber 12 is flipped downward with appropriate force by the wrist of the pitching arm at the appropriate point in the pitcher's delivery or arm path. When the pitching arm angle, pitching arm path, and wrist action are properly executed, as described hereinabove, the ball B will be properly discharged from chamber 12 toward the desired target and the "feel" associated with throwing a curve ball will be transferred or conveyed to the practicing pitcher.

It is to be understood that only the ball B, and not the device 10, is thrown or pitched during the practice act. That is, the device 10 remains gripped by the practicing pitcher, as described hereinabove, throughout the practice act. Further, the chamber 12 remains secured to the ball 22 throughout the practice act. It is also to be understood that the practicing pitcher may repeat the practice act described hereinabove with a plurality of successive balls B. Further, it is to be understood that when the device 10 is properly gripped, as described hereinabove, the biceps, forearm, and hand of the pitching arm will have the proper confirmation.

While the curve ball training device of the present invention has been described in connection with the preferred embodiment, it is not intended to limit the invention to the particular form set forth, but on the contrary, it is intended to cover such alternatives, modifications, and equivalents, as may be included within the spirit and scope of the invention as defined by the appended claims.

I claim:

1. A device for training a pitcher to impart a curved trajectory to a ball, comprising:

a chamber having a cavity adapted to receive a projectile therein, said chamber further having a mouth for permitting insertion of sid projectile into said cavity and discharge of said projectile from said cavity; and a grip member secured to sid chamber exterior to said cavity, said grip member having substantially the same size and feel to said ball, whereby a pitcher in training may use said device to emulate the wrist motion associated with throwing a curve ball.

2. A device for training a pitcher to impart a curved trajectory to a ball, as recited in claim 1, wherein said chamber comprises a bottom and a said wall and said side wall has a substantially uniform taper from said mouth to said bottom.

3. A device for training a pitcher to impart a curved trajectory to a ball, as recited in claim 1, wherein said grip member comprises a baseball.

4. A device for training a pitcher to impart a curved trajectory to a ball, as recited in claim 1, wherein said chamber comprises a bottom and a side wall.

5. A device for training a pitcher to impart a curved trajectory to a ball, comprising:

a chamber having a bottom and a side wall, said bottom and said side wall defining a cavity adapted to receive a projectile therein, said chamber further having a mouth for permitting insertion of said projectile into said cavity and discharge of said projectile from said cavity, said side wall being adapted to abut against said projectile so as to hold said projectile snugly within said chamber; and a substantially spherical grip member secured to said chamber exterior to said cavity, said grip member having substantially the same size and feel of said ball, whereby a pitcher in training may use said device to practice the motor skills associated with throwing a curve ball.

6. A method for practicing the motor skills associated with imparting a curved trajectory to a ball, comprising the steps of:

providing a device having a chamber, said chamber having a substantially spherical grip member secured thereto, said grip member having substantially the same size and feel of said ball;

inserting a projectile into said chamber;

gripping said grip member with a pitching hand;

extending sid pitching hand rearward; and emulating the pitching arm and wrist motions associated with throwing a curve ball, thereby discharging said projectile from said chamber in a direction substantially toward a desired target.

7. A device for training a pitcher to impart a curved trajectory to a ball, comprising:

a chamber having a cavity adapted to receive a ball therein, said chamber further having a mouth for permitting insertion of said ball into said cavity and discharge of said ball from said cavity;

a substantially spherical grip member secured to said chamber exterior to said cavity; and means for securing said grip member to said chamber, said grip member securing means extending radially inward into said grip member from a periphery of said grip member, said grip member having substantially the same size and feel of said ball, whereby a pitcher in training may use said device to practice the motor skills associated with throwing a curve ball.

8. A device for training a pitcher to impart a curved trajectory to a ball, as recited in claim 7, wherein said means for securing said grip member to said chamber comprises a screw.

9. A training device for a pitcher, comprising:

a chamber having a cavity adapted to receive a ball therein, said chamber further having a mouth for permitting insertion of sid ball into said cavity and discharge of said ball from said cavity; and a substantially spherical grip member secured to sid chamber exterior to said cavity in a manner permitting rotation of said grip member to a small degree whereby a pitcher in training may use said device to practice the motor skills associated with throwing a curve ball.

10. A training device for a pitcher, as recited in claim 9, wherein said grip member comprises a baseball.

* * * * *